United States Patent [19]

Gollinger et al.

[11] Patent Number: 4,905,593

[45] Date of Patent: Mar. 6, 1990

[54] COMBINED DAMPING AND CYLINDER CLEANING SYSTEM FOR A PRINTING MACHINE

[75] Inventors: Franz X. Gollinger, Hirschbach; Georg Bock, Augsburg, both of Fed. Rep. of Germany

[73] Assignee: Man Roland Drucksmaschinen AG, Offenbach am Main, Fed. Rep. of Germany

[21] Appl. No.: 386,565

[22] Filed: Jul. 27, 1989

[30] Foreign Application Priority Data

Aug. 2, 1988 [DE] Fed. Rep. of Germany ..... 3826222

[51] Int. Cl.[4] ..... B41L 25/00

[52] U.S. Cl. ..... 401/148; 104/425

[58] Field of Search ..... 101/148, 423, 424, 425, 101/350

[56] References Cited

U.S. PATENT DOCUMENTS 3,673,959 7/1972 Jezruit et al. ..... 101/425

4,036,131 7/1977 Elmore ..... 101/148

*Primary Examiner*—Edgar S. Burr

*Assistant Examiner*—Ren Yan

*Attorney, Agent, or Firm*—Frishauf, Holtz, Goodman & Woodward

[57] ABSTRACT

To eliminate a separate cleaning roller to clean a forme cylinder and in application roller in a printing machine system, and utilize existing rollers of the damping system to apply cleaning fluid, a support lever (8, 26) axially journals and retains a damping liquid application roller (1) and a damping liquid transport roller (2); a pivot lever (11) is pivotably coupled to the supply lever (8, 26), and a guide arrangement is provided, for example formed by a link system (14, 15, 16) or a cam track and cam control element (27, 28) to control movement of the support lever under control of an operating element, such as a solenoid or a piston-cylinder arrangement (13). Movement of the support lever is controlled by the guide means between a first position a first position, in which the damping liquid application roller is engaged on the forme cylinder (4) and the damping liquid transport roller (2) is in surface engagement with the damping liquid application roller and the liquid supply roller and a second position, in which the damping liquid application roller is in liquid transfer contact with the cleaning fluid supply means (18) and the transport roller (2) is in engagement with the ink application roller (5).

11 Claims, 3 Drawing Sheets

COMBINED DAMPING AND CYLINDER CLEANING SYSTEM FOR A PRINTING MACHINE

The present invention relates to printing machines, and more particularly to rotary off set printing machines having a damper, in which the damper is combined with a cleaning system to permit ready cleaning of an ink application roller and hence of a plate cylinder with which the ink application roller is in surface contact.

BACKGROUND

Dampers which include a cleaning system are known, see for example German Utility Model GM 1 932 642. In this system, a plate cylinder can have, selectively, ink applied thereto by an ink application roller or cleaning fluid. The ink application roller is coupled to other rollers of an ink system. Cleaning fluid is applied to an additional roller which can be coupled between the ink and damper application roller.

THE INVENTION

It is an object to simplify an ink cleaning system by using already present rollers within the printing machine. The system should be compatible with flexographic printing systems. It can simultaneously serve as an application system to apply cleaning fluid, so that no additional rollers are required in order to apply cleaning fluid to the plate cylinder.

Briefly, the liquid application roller, normally in contact with the plate cylinder, can be changed in position for selective engagement either, normally, with the plate cylinder or to apply cleaning fluid to one of the rollers of the damper system, which roller is then engaged with the ink application roller.

The system has the advantage that, selectively, damping fluid or cleaning fluid can be applied to the plate or the forme cylinder without requiring any additional rollers or any cylinders which are not present in the rotary printing machine anyway. The system has the further advantage that cleaning fluid, upon shifting to the cleaning position, can be applied automatically by transport, for example from a cleaning fluid supply trough, therefore not requiring operator attendance during the cleaning operation.

DRAWINGS

DETAILED DESCRIPTION

Figure 1:
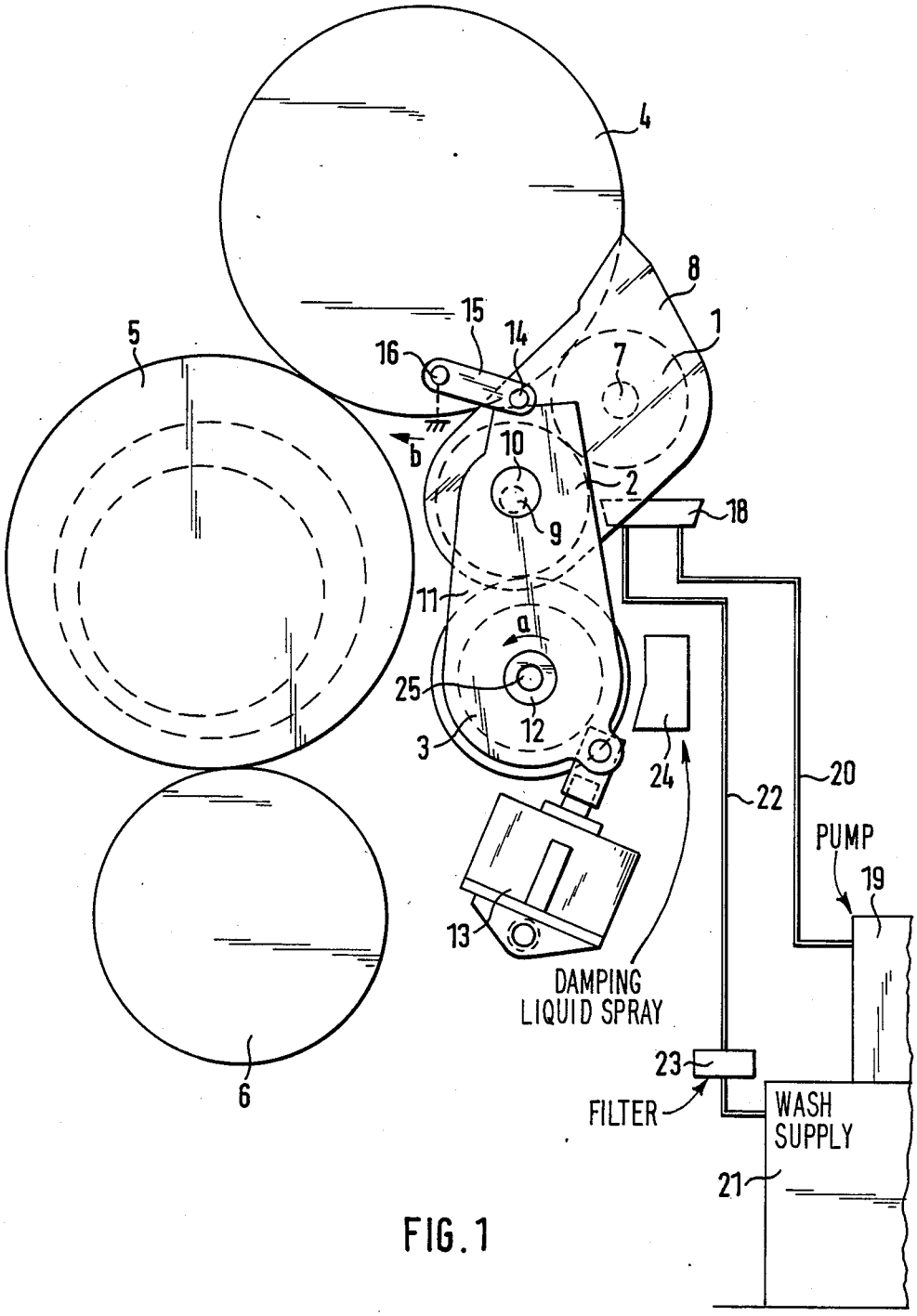
FIG. 1 is a highly schematic side view of a rotary offset printing machine cylinder and a damper and ink application roller, in which the respective rollers are in the position applying, respectively, ink and damping fluid to a forme cylinder.

The damper includes a damping liquid application roller 1. A typical damping liquid is water. The damping liquid application roller receives damping liquid from a transport roller 2 which, in turn, receives damping fluid from a supply roller 3. A damping liquid spray device 24 sprays damping liquid on the supply roller 3. Suitably, the application roller 1 and the transport roller have an elastic roller surface, for example hard rubber, or a comparable plastic material; the supply roller 3 has a metallic surface which is hydrophilic, that is, accepting water. Chromium is a typical surface for supply roller 3. The application roller 1 cooperates with a forme cylinder 4 which carries a printing image. The forme cylinder 4, for example a plate cylinder, receives ink from an ink application roller 5 which is in contact with a further ink supply roller 6, for example a screen-type roller or an anilox roller.

The application roller 1 has a shaft 7 which is rotatably retained in a support lever 8. The transport roller 2 is rotatably retained on a shaft 9. Shaft 9 is retained in the support lever 8, secured against rotation with respect thereto. The shaft 9, further, has eccentrically located bearing pins 10 thereon, which are freely rotatable in a pivot lever 11. The pivot lever 11 is pivotable about fixed bushings 12, the longitudinal axes of which are coincident with a shaft 25. Shaft 25 carries the supply roller 3 and suitable gears to drive the shaft 25 and the supply roller 3. Only one side of the support for the respective rollers has been described; a mirror image - identical system is located at the other axial ends of the rollers and shafts.

The pivot lever 11 is operated by an operating or positioning arrangement 13 which may be of any suitable form; it may be a hydraulic or pneumatic piston-cylinder arrangement, or an electrically operated solenoid arrangement. The operating device 13 can pivot the pivot lever 11 about the axis of bushing 12 in the direction of the arrow a or contrary to the direction of the arrow a.

The support lever 8 further carries a pin 14 which is connected to a link 15. The other end of the link 15 is pivotably coupled to a pin 16 which is connected to a side wall 17 of the printing machine.

A trough 18 is located beneath the application roller 1. Trough 18 receives cleaning fluid from a washing supply 21 via a pump 19 and a line 20. After termination of washing, the trough 18 can be drained through line 22 and used cleaning fluid is filtered by a filter 23 and returned to the supply 21.

The spray 24 provides damping liquid to the supply roller 3. The damping liquid, when the rollers are in the position shown in FIG. 1, is transferred via the transport roller 2 to the application roller 1 and then to the forme cylinder 4.

Operation

Under normal, printing machine operation, damping liquid is applied from spray 24 and via rollers 3, 2, 1 to the forme cylinder 4. If the system is to be used to wash the forme cylinder, the operating device 13 is operated and the rollers will then shift into the position shown in FIG. 2. The pivot lever 11 will move in the direction of the arrow a and pivot about the bushing 12. The pin 10 with the shaft 9 follows this pivoting movement. This, as a consequence, moves the support lever 8 generally in the direction of the arrow b, see FIG. 2. The link 15 ensures movement of the application roller 1 in a predetermined path with respect to the trough 18 and the transport roller 2 and towards the ink application roller 5. Upon drive of the rollers 5, 6 (FIG. 1), transport roller 2 and application roller 1 are carried along by friction and cleaning fluid is transported to the ink application roller 5.

Figure 2:
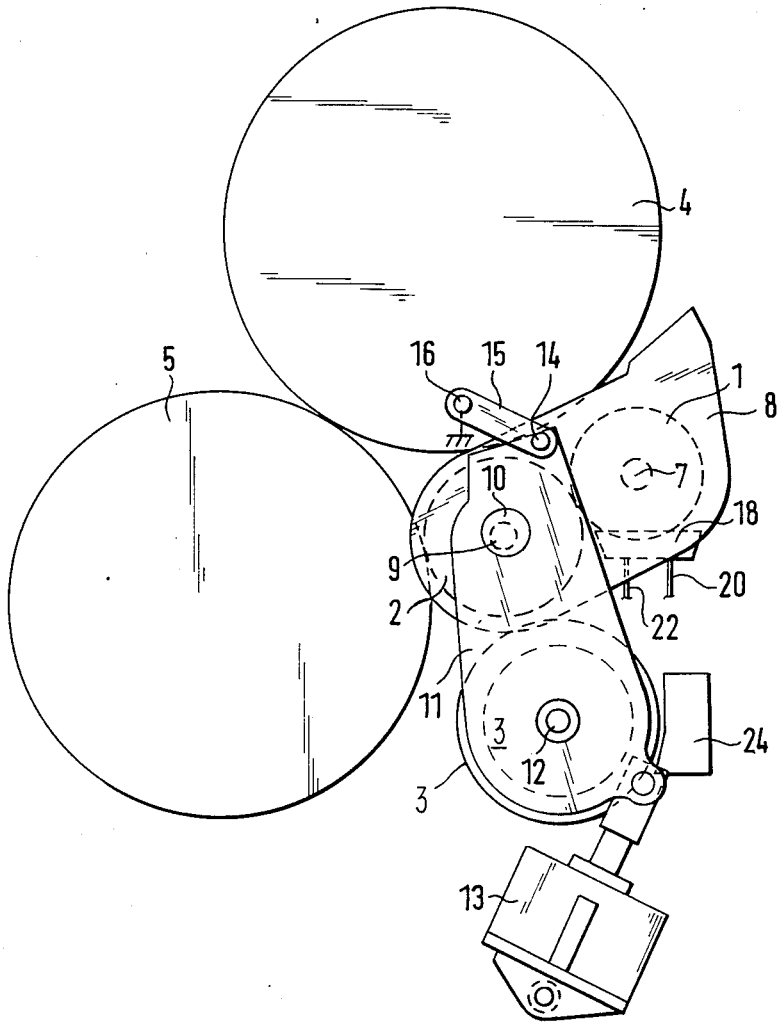
FIG. 2 is a view similar to FIG. 1, in which the rollers have been shifted for cleaning.

The eccentricity between the shaft 9 and the bearing pin or support 10 raises the transport roller 2 upon change-over from the position in FIG. 1 to the position in FIG. 2, that is, to the washing position, and thus lifts the transport roller 2 off the damping liquid supply roller 3. This is desirable in order to prevent remnants of cleaning fluid from remaining on the supply roller 3 which, upon subsequent damping of the forme cylinder 4, may have undesirable effects on printing quality from the forme cylinder. If the requirements for quality are comparatively low, and time is of the essence, that is, further printing should be carried out immediately after cleaning and washing, the eccentricity between the shaft 9 and the bearing 10 can be eliminated so that the supply roller 3 even during washing remains in contact with the transport roller 2.

Figure 3:
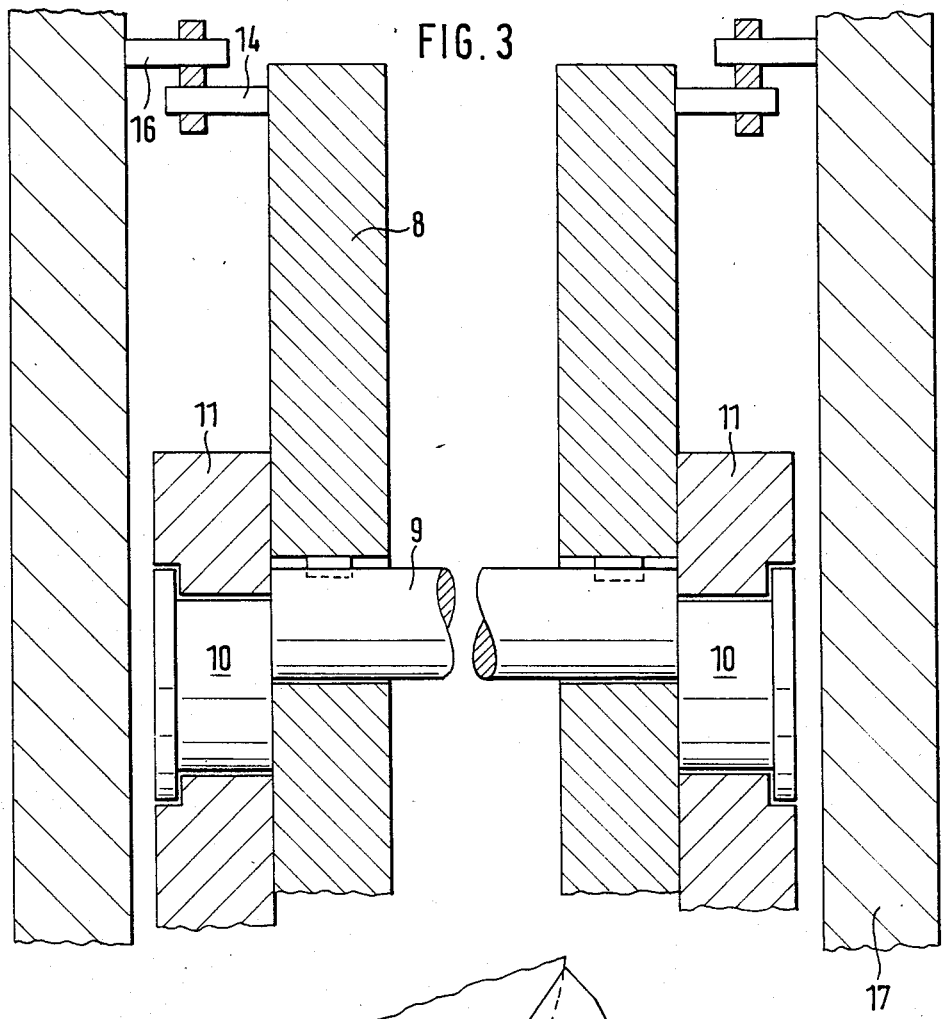
FIG. 3 is a fragmentary cross-sectional view illustrating a detail.
Figure 4:
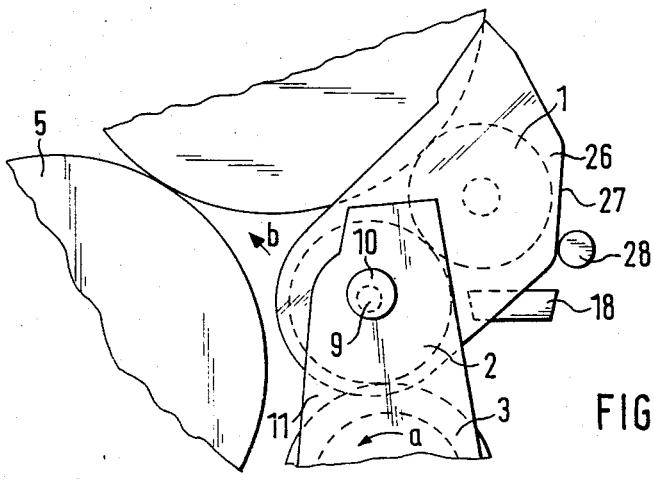
FIG. 4 is a view similar to FIG. 1 and illustrating another embodiment.

In the embodiment of FIG. 4, the guidance of the transport roller 2 is differently carried out; the application roller 1 and the transport roller 2 are retained in a support lever 26. Transport lever 26 is pivotably retained by bearing pin 10 on the pivot lever 11. Rather than using the link 15, as shown in FIGS. 1–3, a position control curve 27 is provided on the support lever 26. Of course, a similar position control curve is provided on the other axial side of the system. The control curves 27 cooperate with the fixed pin 28, secured to a side wall 17 of the printing machine for controlling movement of the lever 26.

Operation of the embodiment of FIG. 4

To move the damper from the position shown in FIG. 4 into the cleaning position, the pivot lever 11 is moved in the direction of the arrow a by the operating element 13, thereby pivoting about the bushing 12. The pivot lever carries along the shaft 9 and, if located on the eccentric bushing 10, first the eccentric bushing 10. The support lever 26 is thereby moved in the direction of the arrow b. As in the embodiment of FIG. 1, the shaft 9, if eccentrically located on pin 10, is rotatably immovably secured on the support lever 26. The support lever 26 has its movement controlled by cooperation of the cam track 27 with the fixed pin 28. The cam track 27, upon movement of the pivot lever 11, causes the support lever 26 to slide along the fixed pin 28. As the support lever 26 moves in the direction of the arrow b, the transport roller 2 is lifted off the liquid supply roller 3—provided the eccentric bushing 10 is used—and, in any event, the transport roller 2 is engaged with the ink application roller 5. At the same time, the damping liquid application roller 1 is dropped to dip into the trough 18.

Ordinarily, the weight of the lever 26 and of the rollers 1, 2 ensures reliable engagement of the control curve 27 with the pin 28. If this weight should not be sufficient to provide for such reliable engagement, by gravity, a spring engaging the lever 26 can be provided to retain the cam track 27 in engagement with the pin 28.

Other arrangement are possible, for example the cam track 27 may be formed as a slit in which the pin 28 is engaged. This, also, permits elimination of a separate spring. The pin 28 can be surrounded by a rotating sleeve for decreased friction.

Various changes and modifications may be made, and any features described herein may be used with any one of the embodiments, within the scope of the inventive concept.

We claim:

1. Combined damping and cleaning system for a printing machine having a forme cylinder (4) and an ink application roller (5) for supplying ink to the forme cylinder, said system permitting, selectively, application of damping liquid to the forme cylinder or cleaning fluid to the ink application roller, wherein the damping system includes a damping liquid application roller (1);

a damping liquid transport roller (2); and a damping liquid supply roller (3);

a cleaning fluid supply means (18);

support lever means (8, 26) axially journalling and retaining the damping liquid application roller (1) and the damping liquid transport roller (2);

a pivot lever (11) pivotably coupled to the support lever means (8, 26);

lever guide means (14, 15, 16; 27, 28) controlling movement of the support lever means (8, 26); and operating means (13) coupled to the pivot lever (11) for moving the pivot lever and thereby control movement of the support lever means (8, 26) as guided by the lever guide means between a first position, in which the damping liquid application roller is engaged on the forme cylinder (4) and the damping liquid transport roller (2) is in surface engagement with the damping liquid application roller and the liquid supply roller, and a second position, in which the damping liquid application roller is in liquid transfer contact with the cleaning fluid supply means (18) and the transport roller (2) is in engagement with the ink application roller (5).

2. The system of claim 1, wherein said lever guide means comprises a pivot link (15) pivotably attached with one end on the support lever means (8) and with the other end fixed to a side wall (17) of the printing machine.

3. The system of claim 1, wherein the guide means comprises a guide cam track (27) and a fixed engagement element (28) secured to a side wall of the printing machine, the guide cam track being formed on the support lever means (26).

4. The system of claim 1, wherein the support lever means (8, 26) is pivotably secured to pivot about a bearing element (10) eccentrically surrounding a shaft (9) secured to the damping liquid transport roller.

5. The system of claim 1, wherein the pivot lever (11) is pivotable about the longitudinal axis of the damping liquid supply roller (3).

6. The system of claim 1, wherein the operating means comprises a positioning element (13) operable by at least one of: hydraulic energy; pneumatic energy; electrical energy.

7. The system of claim 1, wherein said cleaning fluid supply means comprises a supply trough (18) positioned such that the damping liquid application roller (1) can dip into cleaning fluid within said cleaning fluid supply trough (18).

8. Combined damping and cleaning system for a printing machine having a forme cylinder (4) and an ink application roller (5) for supplying ink to the forme cylinder, said system permitting, selectively, application of damping liquid to the forme cylinder or cleaning fluid to the ink application roller, wherein the damping system includes a damping liquid application roller (1);

a damping liquid transport roller (2);

a damping liquid supply roller (3);

a cleaning fluid supply means (18);

and comprising, in accordance with the invention, movable support means (8, 26; 11) retaining said damping liquid application roller (1) and said damping liquid transport roller (2) between side walls (17) of the printing machine;

operating means (13) coupled to the movable support means for moving said movable support means; and guide means (14, 15, 16; 27, 28) guiding movement of the movable support means, and hence of the damping liquid application roller (1) and the damping liquid transport roller (2), upon movement derived from said operating means, between a first position, in which the damping liquid application roller is engaged on the forme cylinder (4) and the damping liquid transport roller (2) is in surface engagement with the damping liquid application roller and the liquid supply roller, and a second position, in which the damping liquid application roller is in liquid transfer contact with the cleaning fluid supply means (18) and the transport roller (2) is in engagement with the ink application roller (5).

9. The system of claim 8, wherein the guide means include an element (16; 28) secured to the printing machine.

10. The system of claim 8, wherein the movable support means (8, 26; 11) include means (9, 10) for changing the position of the damping liquid transport roller (3) with respect to the damping liquid supply roller (3) upon movement of the movable support means from the first to the second position to sever circumferential contact between the damping liquid transport roller and the damping liquid supply roller when said system is in said second position.

11. The system of claim 8, wherein said cleaning fluid supply means comprises a supply trough (18) positioned such that the damping liquid application roller (1) can dip into cleaning fluid within said cleaning fluid supply trough (18).

* * * * *